US005853000A

United States Patent [19]

Torgerson et al.

[11] Patent Number: 5,853,000

[45] Date of Patent: Dec. 29, 1998

[54] ARCHERY BOW RISER WITH WRIST BRACE

[76] Inventors: Michael D. Torgerson, Rte. 1, Box 320, Blair, Wis. 54616; Jeffery A. DeBoer, N5764 CTH OT, Onalaska, Wis. 54650

[21] Appl. No.: 781,591

[22] Filed: Jan. 9, 1997

[51] Int. Cl.[6] ..... F41B 5/00

[52] U.S. Cl. ..... 124/88

[58] Field of Search ..... 124/23.1, 25.6, 124/86, 88, 89

[56] References Cited

U.S. PATENT DOCUMENTS

| | | | |
|---|---|---|---|
| 3,176,674 | 4/1965 | Smith | 124/23.1 |
| 3,599,621 | 8/1971 | Scrobell | 124/88 X |
| 4,343,286 | 8/1982 | Thacker | 124/88 X |
| 4,787,361 | 11/1988 | Vyprachticky | 124/88 |
| 4,966,124 | 10/1990 | Burling | 124/23.1 |
| 5,333,595 | 8/1994 | Heffron | 124/88 |
| 5,531,211 | 7/1996 | Wilfong | 124/86 |

*Primary Examiner*—John A. Ricci
*Attorney, Agent, or Firm*—D. L. Tschida

[57] ABSTRACT

A modular archery bow riser which is machined to accept an adjustable wrist brace, adjustable thumb grip and finger caps. The forward surface of the riser includes a number of finger channels and accepts alternative finger caps having different finger grooving. An aft surface accepts a semi-circular bracket which supports a pivoting upright wrist brace arm. The position of the brace arm is determined with set screws fitted between a slot at the bracket and brace and between telescoping extensions of an alternative brace arm. A horizontal shelf mounts to a side wall of the riser and an adjustable vertical stop mounts to the shelf to support the thumb.

18 Claims, 5 Drawing Sheets

ARCHERY BOW RISER WITH WRIST BRACE

BACKGROUND OF THE INVENTION

The present invention relates to shooting aids for archery and, in particular, to a modular riser or handle section for an archery bow which accepts a wrist brace and attachments for supporting and aligning the fingers and thumb to control the gripping of the riser.

A problem frequently encountered by archers is that of inconsistently gripping the bow. Common gripping problems are over gripping and torquing the handle. Over gripping occurs when the archer grips the hand grip with the heel of the hand or base of the thumb rotated to a condition where the forearm is displaced into the path of the bow string. Torquing occurs when the archer rotates the hand at the hand grip of the bow riser during shooting, which may also cause the arm to rotate into the path during the shooting motion.

Over gripping or torquing the bow handle during shooting can induce erratic arrow flight. Improper arrow flight is discernable with movement of the feathered end of the arrow during flight or at a target with one or more arrows being canted from a true line of flight. That is, instead of all the arrows lying parallel to one another and to the geometric straight line of flight, one or more arrows may be canted at different angles from the flight line and the other arrows. Erratic arrow flight is to be avoided since it reduces accuracy and the kinetic energy carried by the arrow.

An over rotated grip can also induce the string to strike the forearm or arm guard. The resulting shock can effect arrow flight through loss of energy to the archer and reduced arrow speed. Injury may also result to the archer's forearm. Archers most commonly treat this condition by wearing an arm guard about the forearm and wrist. Arm guards shield the arm, if stuck by the string.

Applicant is aware of two arm guards shown at U.S. Pat. No. 5,103,798 and 5,137,008, which mount to the bow, and which are positioned between the forearm and string and extend beyond the normal rest position of the string. The guards act as barriers to prevent the string from striking an archer's arm.

Wrist slings are also used to retain the bow to the hand, if a loose grip causes the bow to fall from the hand. A variation on the wrist slings is a wrist brace shown at U.S. Pat. No. 4,836,177 which provides a padded rigid U-shaped frame that mounts to the riser. The frame displaces an archer's arm to the side of the string's travel path.

Modular palm plates are also known that mount to a riser to accommodate different size hands and direct the positioning of the heel of the hand to the riser. Some plastic palm grips are self supported to the riser. Some wooden palm grips are secured to the riser with mounting screws. Applicant is not aware of any modular grips which include finger grooves or restrict movement of the thumb.

The present archery bow riser was developed to custom fit and control an archer's grip. The riser is shaped to accept a number of modular attachments which can be used individually or collectively. A wrist brace mounts to the riser and can be rotated for use by right or left handed archers. The mounting position is selectively adjusted to contact the wrist, aft of the hand grip and forward of the limb cables and rest position of the bow string. Selected finger caps mount to the forward surface of the riser and include grooving to stabilize the fingers. A shelf separately attaches to a sidewall of the riser to support the thumb. A vertical stop plate contains the thumb to the shelf.

SUMMARY OF THE INVENTION

It is a primary object of the invention to provide a means for controlling the gripping of an archery bow handle or riser to prevent over gripping or rotation of the riser during shooting.

It is a further object of the invention to provide a modular riser which supports an adjustable wrist brace assembly, and which forces a preferred gripping of the riser that restricts wrist, hand and finger movement.

It is a further object of the invention to provide a wrist brace assembly that can be length adjusted and rotated relative to the riser to fit right or left handed shooters.

It is a further object of the invention to provide a modular hand grip which accepts finger cap pieces to custom fit the riser to an archer's grip.

It is a further object of the invention to provide a detachable thumb rest and attachment plate for containing the thumb to the riser.

Various of the foregoing objects, advantages and distinctions of the invention are obtained in an archery bow riser which supports a slotted mounting bracket and from which an upright brace arm projects. A shelf of the bracket includes a 180 degree arcuate slot. The brace arm pivots at the bracket and a locking screw secures the brace arm to the slot to fix the orientation of the brace arm to an archer's wrist. The brace arm ensures the wrist is laterally displaced to the side of the travel path of the bow string. In an alternative construction, a telescoping brace arm is provided. The position of either brace arm can be adjusted relative to the riser to accommodate right or left handed archers.

A forward surface of the riser is formed to provide modified finger grooves. Alternative finger caps align to the riser to enlarge the grip with selectively pronounced finger grooves.

A side surface of the riser is formed to accept a thumb rest. The thumb rest projects from the riser and accepts a vertically adjustable attachment plate. The rest and plate contain the thumb to the riser. Collectively, the wrist brace, finger caps and thumb rest control the gripping of the riser to assure a uniform gripping, each and every shot, and prevent erratic arrow flight.

Still other objects, advantages and distinctions of the invention will become more apparent upon reference to the following description with respect to the appended drawings. The description should not be literally construed in limitation of the invention, which instead should be interpreted to include all equivalent constructions within the scope of the further appended claims.

BRIEF DESCRIPTION OF THE DRAWINGS

Wherein like parts are referenced by similar call-outs at the various views.

DESCRIPTION OF THE PREFERRED EMBODIMENT

Figure 1:
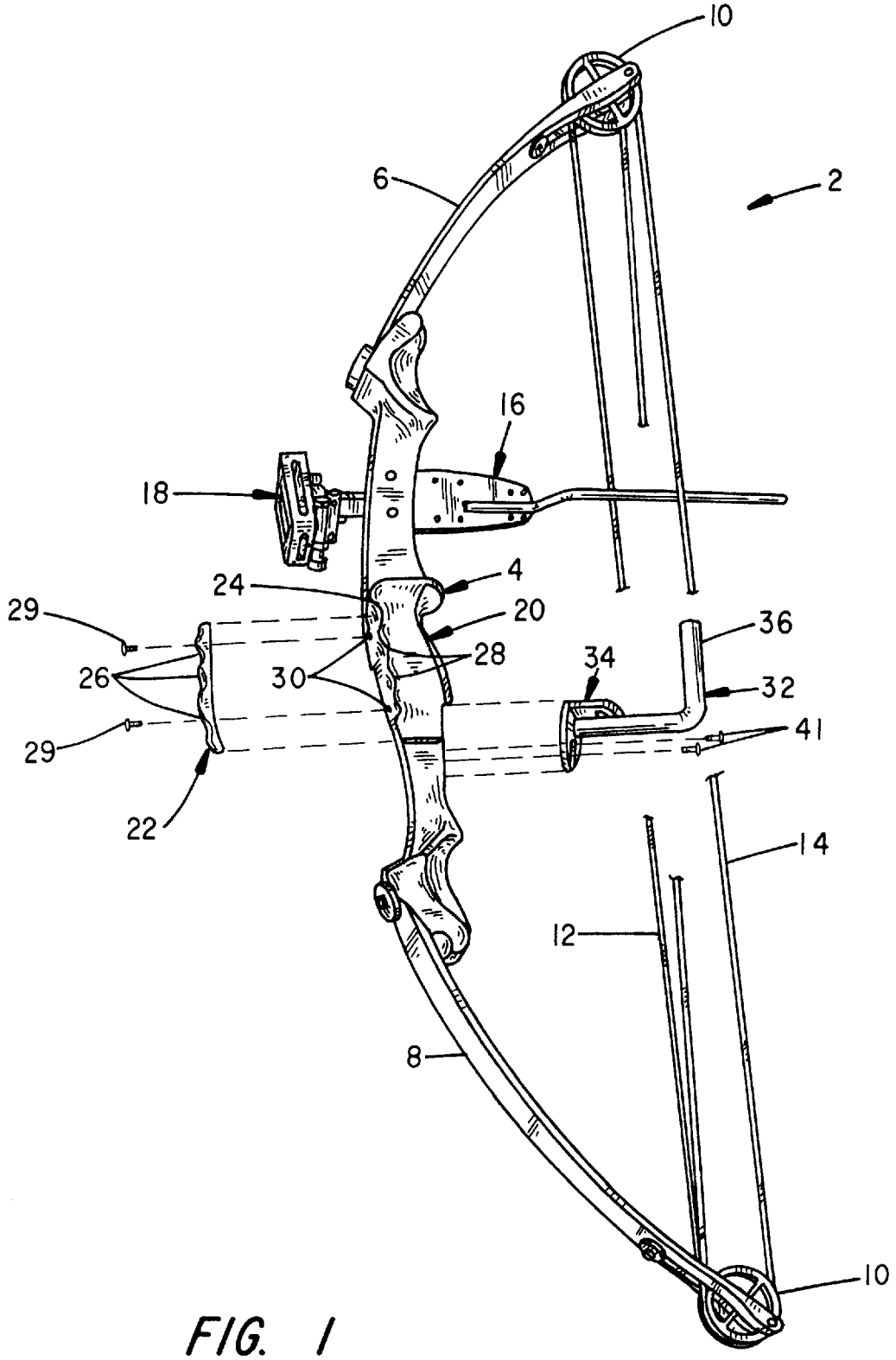
FIG. 1 is a perspective drawing shown in exploded assembly to an archery bow fitted with an adjustable wrist brace and finger grip of the invention.

Referring to FIG. 1, a perspective drawing is shown to a compound bow 2 fitted with the modular handle riser 4 of the invention. The riser 4 supports a pair of limbs 6 and 8. The limbs 6 and 8 contain a pair of wheels or cams 10 and about which a cable 12 and a bow string 14 are trained. A cable guard 16 and sight 18 are separately supported to the riser 4. Although the riser 4 is constructed to fit one type of compound bow, it can be adapted to a variety of different bow constructions, including any of numerous compound bow constructions having different force let-off characteristics, recurve bows or long bows.

Secured to the forward surface of the grip 20 is a finger cap 22. One or more conventional palm plates 24 can be separately mounted to the side walls of the grip 20. The palm plates 24 are supported by screws or a compressive action. The palm plates 24 vary the lateral thickness of the grip 20 and control the mounting of the heel of the hand to the riser 4.

The finger cap 22 separately includes a number of grooves or channels 26 that individually support the fingers. The grip 20 is machined with a number of shallow finger grooves 28 at the front surface, reference FIG. 4, but which are accentuated by selectively attaching a finger cap 22 of choice having a differing groove depth. The finger cap is shaped to extend the grooves 28 at varying depths. The finger cap 22 is attached with a pair of screws 29 fitted to tapped holes 30 at the riser 4. The finger cap 22 may be used without palm plates 24 to size the grip 20.

A wrist brace 32 is supported to the riser 4 beneath the grip 20 with several other screws 41 that are fitted to a bracket 34. An upright brace arm 36 is secured to the bracket 32 to pivot over a nominal range of 180 degrees. The brace arm 36 extends between the riser 4 and cable 12. The position of the brace arm 36 is laterally adjusted to contact the wrist and control the gripping of the hand grip 20. That is, rotation of the brace arm 36 laterally controls the displacement of the wrist relative to the travel path of the string 14 and correspondingly controls the grip an archer is able to obtain at the hand grip 20. The brace arm 36 can be adjusted to accommodate right or left hand shooters. Although the term brace is used, it is to be appreciated the actual physical contact between the brace arm 36 and the wrist is relatively light, with the brace arm 36 providing more of a rest or limit to the movement of the wrist and immediately adjacent forearm.

The position of the brace arm 36 is normally adjusted to prevent an archer from over gripping the hand grip 20 or rotating the hand and wrist into the travel path of the string. Consistent gripping and arrow flight are thereby obtained for each and every shot.

Figure 2:
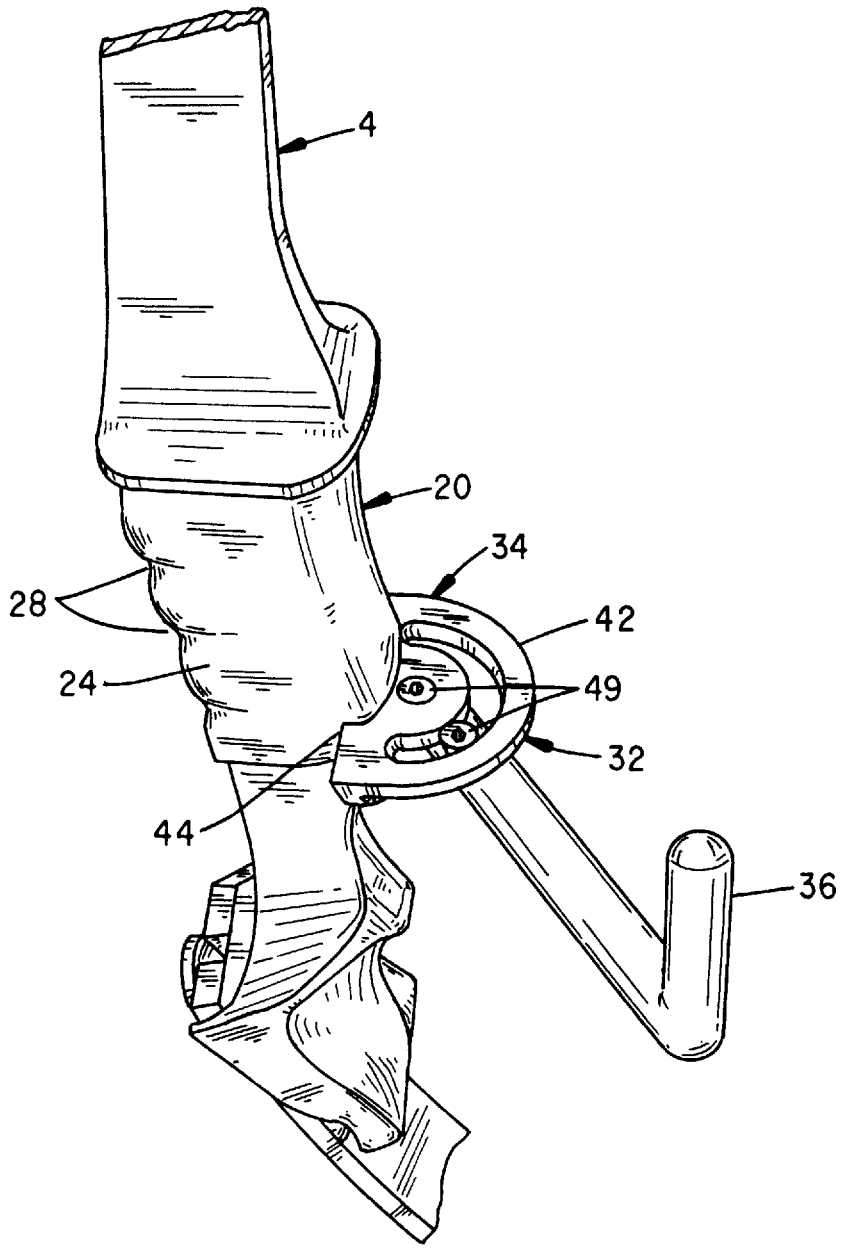
FIG. 2 is a perspective drawing to the wrist brace of FIG. 1.
Figure 3:
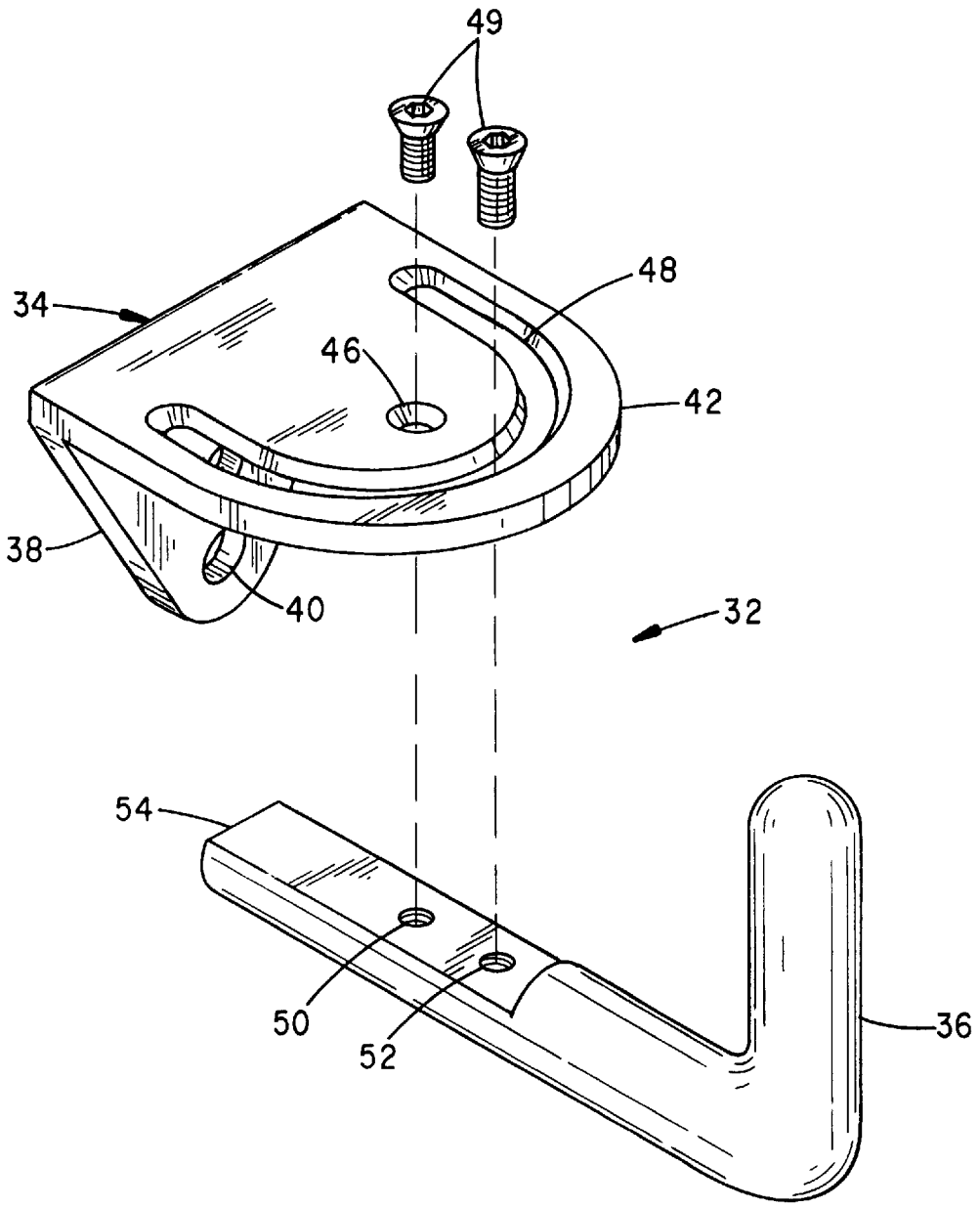
FIG. 3 is an exploded assembly drawing of the wrist brace of FIG. 1.

With additional attention to FIGS. 2 and 3, particular details to the construction of the wrist brace 32 of FIG. 1 are apparent. The bracket 34 is secured to the riser 4 at a riser attachment plate 38. Apertures 40 accept a pair of screws 41, upon aligning an adjustment plate 42, which projects at ninety degrees to the attachment plate 38, to a notch 44 at the riser 4, which secure the bracket 34 to the riser 4.

The adjustment plate 42 includes an aperture 46 and an arcuate slot 48 and each of which accept a screw 49. The screws 49 mount to threaded holes 50 and 52 at a flat surface 54 of the lower lying brace arm 36. The flat surface 54 abuts the adjustment plate 42 and prevents the brace arm 36 from twisting relative to the riser 4. The brace arm 36, otherwise, rotates or pivots about the screw 49 at the aperture 46. The screw 49 at the slot 48, in turn, serves as a set screw to fix a desired rotation of the brace arm 36 between the end limits of the slot.

Although one pivoting, mounting of the brace arm 36 to the riser 4 is shown, a variety of other adjustable arrangements can be constructed to achieve the same end. For example, the brace arm 36 might be mounted to selected bores or a channel at the riser 4, which permit different angular orientations, and without the need for a bracket 34.

Figure 5:
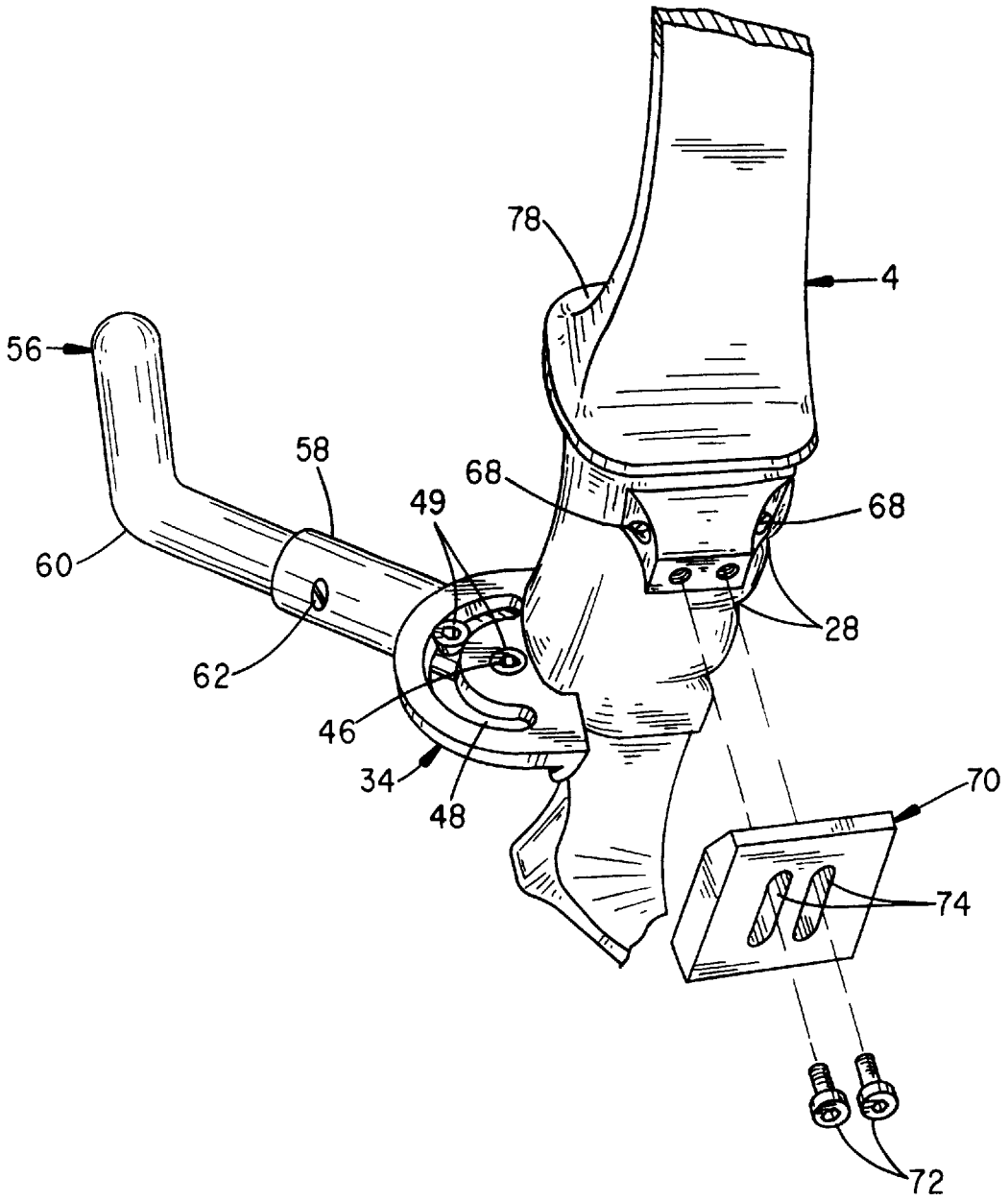
FIG. 5 is an exploded assembly drawing to the thumb grip.

The brace arm 36 might also be constructed to telescope to facilitate positioning to the wrist, reference the brace arm 56 at FIG. 5. The brace arm 56 includes a tubular support arm 58 that mounts to the bracket 34 and within which a solid arm 60 telescopes. The arm 60 may be separately rotated about the axis of the support arm 58. A set screw 62 fixes the extension and rotation of the arm 60.

Figure 4:
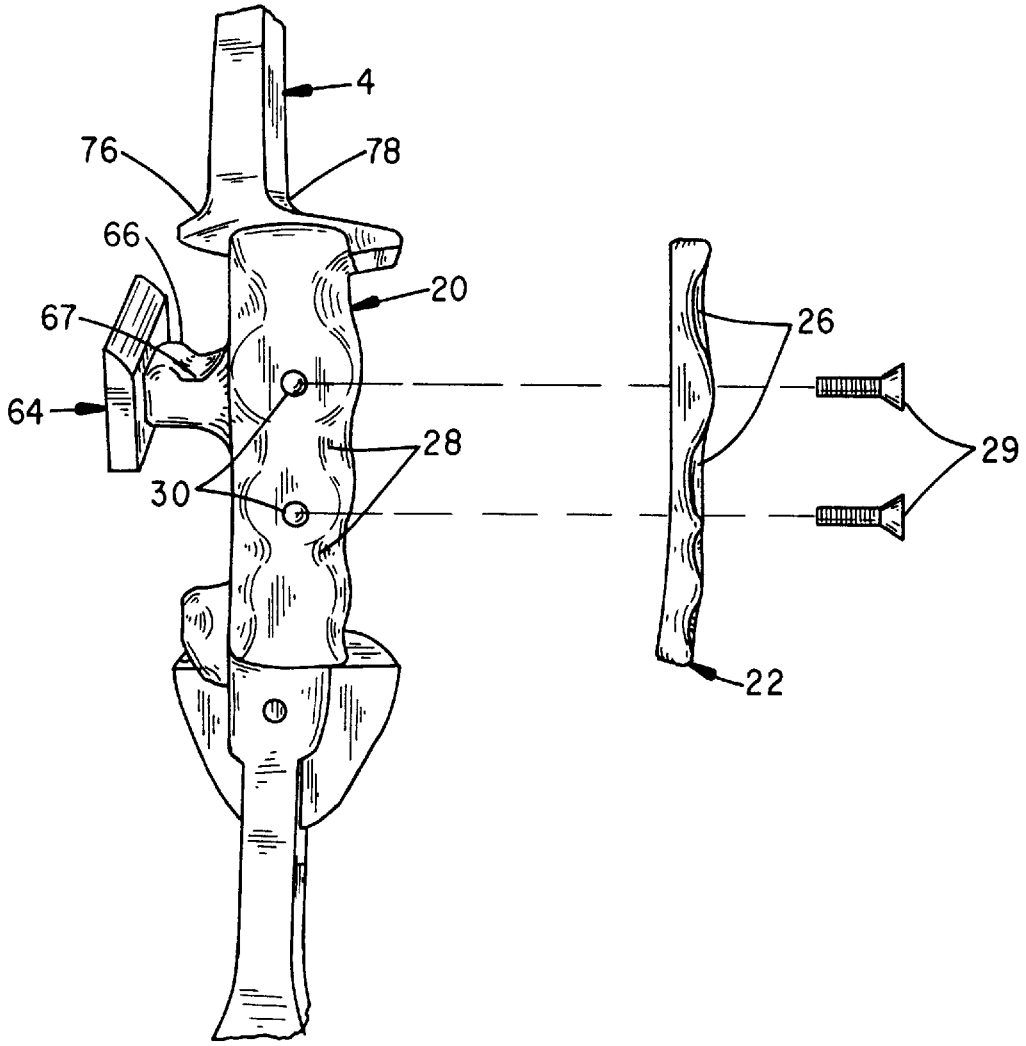
FIG. 4 is front view shown in exploded assembly to the adjustable thumb grip and finger grip.

A modular thumb rest 64 may also be fitted to the riser 4 as shown at FIGS. 4 and 5. Any included palm plates 24 or finger cap 22 may have to be adjusted to accommodate the thumb rest 64. The thumb rest 64 includes a horizontal shelf 66 that has a depression 67 which receives the thumb. The shelf 66 can be fitted to the side of the riser 4 opposite an arrow shelf 78 with screw fasteners 68 that extend through the shelf 66.

Separately secured to the end of the shelf 66 is a vertical stop plate 70 which prevents the thumb from prematurely being released from the grip 20. Screws 72 mount through slots 74 at the stop plate 70, which can be vertically adjusted relative to a flange 76 that projects opposite an arrow shelf 78. The stop plate 70 and flange 66 essentially define a thumb hole which assures a complete gripping of the bow and also prevents the archer from inadvertently releasing the riser 4, which prevents accidental dropping of the bow 2.

The riser 4, wrist braces 32 and 56 and thumb rest 64 are presently molded and machined from a light weight metal, such as aluminum, although can be fabricated from a number of other materials, including fiberglass, reinforced molded plastics, and a variety of other materials and composites. In lieu of modular mountings, the brace 32 and thumb rest 64 can be integrated into the riser 4.

While the invention has been described with respect to a number of presently preferred constructions, still other constructions might be suggested to those skilled in the art. The invention should therefore be construed to include all those constructions within the spirit and scope of the following claims.

What is claimed is:

1. A handle for an archery bow having a bow string comprising:

a) a riser shaped to provide a recessed hand grip region beneath an arrow support shelf;

b) wrist brace means comprising a bracket secured to said riser and having a brace arm which projects substantially parallel to the bow string and which arm is supported to pivot at an adjustment plate of said bracket between first and second limits defined by said adjustment plate; and c) means for fixing said brace arm to said adjustment plate at a preferred rotation, whereby the brace arm can be adjusted to displace an archer's wrist lateral of a travel path of the bow string and control an archer's gripping of the hand grip.

2. A handle as set forth in claim 1 wherein said brace arm comprises first and second sections which telescope from one another and including means for fixing a preferred extension of said first and second sections relative to one another.

3. A handle as set forth in claim 1 wherein said brace arm comprises first and second sections which telescope from one another, wherein one of said first and second sections rotates within the other, and including means for fixing a preferred extension and rotation of said first and second sections relative to one another.

4. A handle as set forth in claim 1 including finger cap means having a plurality of depressions which receive individual fingers and which finger cap means mount to a forward surface of said hand grip.

5. A handle as set forth in claim 1 including thumb rest means for supporting a thumb to the handle.

6. A handle as set forth in claim 5 wherein said thumb rest means include a shelf which projects substantially orthogonal to a side wall of said handle and further include stop means fitted to the shelf to constrain the thumb to the shelf.

7. A handle as set forth in claim 1 including palm plate means fitted to a sidewall of said riser for varying the lateral thickness of said hand grip.

8. A handle as set forth in claim 1 wherein said brace arm includes a flat surface which abuts and rotates about said adjustment plate.

9. A handle for an archery bow having a bow string comprising:

a) a riser shaped to provide a recessed hand grip region beneath an arrow support shelf;

b) wrist brace means secured to said riser comprising a brace arm which projects substantially parallel to the bow string and which brace arm is secured to a bracket having an arcuate slot, and wherein said brace arm pivots about the slot; and c) means for fixing a preferred rotation of said brace arm, whereby the brace arm can be adjusted to displace an archer's wrist lateral of a travel path of the bow string and control an archer's gripping of the hand grip.

10. A handle as set forth in claim 9 wherein said brace arm comprises first and second sections which telescope from one another and including means for fixing a preferred extension of said first and second sections relative to one another.

11. A handle as set forth in claim 10 wherein said brace arm comprises first and second sections which telescope from one another, wherein one of said first and second sections rotates within the other, and including means for fixing a preferred extension and rotation of said first and second sections relative to one another.

12. A handle as set forth in claim 9 including thumb rest means for supporting a thumb to the handle.

13. A handle as set forth in claim 12 wherein said thumb rest means includes a shelf which projects substantially orthogonal to a side wall of said handle, and further includes stop means fitted to the shelf to constrain the thumb to the shelf.

14. A handle as set forth in claim 9 including finger cap means having a plurality of depressions which receive individual fingers, and which cap means mounts to a forward surface of said hand grip.

15. A handle as set forth in claim 9 wherein said brace arm includes a flat surface which abuts and rotates about said bracket.

16. A handle for an archery bow having a bow string comprising:

a) a riser shaped to provide a recessed hand grip region beneath an arrow support shelf, wherein finger cap means having a plurality of depressions, which receive individual fingers, mounts to a forward surface of said hand grip region;

b) thumb rest means including a shelf which projects substantially orthogonal to a sidewall of said riser;

c) wrist brace means secured to said riser comprising a brace arm which projects substantially parallel to the bow string and which brace arm is secured to a bracket having an arcuate slot, and wherein said brace arm pivots about the slot; and d) means for fixing a preferred rotation of said brace arm, whereby the brace arm can be adjusted to displace an archer's wrist lateral of a travel path of the bow string and control an archer's gripping of the hand grip.

17. A handle as set forth in claim 16 wherein said thumb rest means includes stop means fitted to the shelf to constrain the thumb to the shelf.

18. A handle for an archery bow having a bow string comprising:

a) a riser shaped to provide a recessed hand grip region beneath an arrow support shelf;

b) wrist brace means secured to said riser comprising a brace arm which projects substantially parallel to the bow string and rotates about a pivot axis at the riser;

c) thumb rest means for supporting a thumb to the handle and wherein said thumb rest means includes a shelf which projects substantially orthogonal to a side wall of said handle and further includes stop means fitted to the shelf to constrain the thumb to the shelf; and d) means for fixing a preferred rotation of said brace arm, whereby the brace arm can be adjusted to displace an archer's wrist lateral of a travel path of the bow string and control an archer's gripping of the hand grip.

* * * * *